US009732582B2

(12) United States Patent
Mansukh et al.

(10) Patent No.: US 9,732,582 B2
(45) Date of Patent: Aug. 15, 2017

(54) WELLBORE SEALING WITH HYBRID WICKER SYSTEM

(71) Applicant: Vetco Gray Inc., Houston, TX (US)

(72) Inventors: Mayur Mansukh, Houston, TX (US); Aniruddha D. Gadre, Houston, TX (US); David Lawrence Ford, Houston, TX (US); Baozhi Zhu, Houston, TX (US); Robert Du, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 399 days.

(21) Appl. No.: 14/498,085

(22) Filed: Sep. 26, 2014

(65) Prior Publication Data

US 2016/0090811 A1 Mar. 31, 2016

(51) Int. Cl.

| | |
|---|---|
| ***E21B 33/04*** | (2006.01) |
| ***E21B 33/128*** | (2006.01) |
| ***E21B 33/03*** | (2006.01) |

(52) U.S. Cl.

CPC ..... *E21B 33/128* (2013.01); *E21B 33/03* (2013.01); *E21B 33/04* (2013.01); *E21B 33/0415* (2013.01)

(58) Field of Classification Search

CPC ..... E21B 33/03; E21B 33/04

See application file for complete search history.

(56) References Cited

U.S. PATENT DOCUMENTS

| | | | | |
|---|---|---|---|---|
| 4,595,053 | A | 6/1986 | Watkins et al. | |
| 4,932,472 | A * | 6/1990 | Boehm, Jr. | E21B 33/04 166/182 |
| 5,211,226 | A | 5/1993 | Hendrickson et al. | |
| 5,299,644 | A * | 4/1994 | Eckert | E21B 33/03 166/379 |
| 8,245,776 | B2 | 8/2012 | Gette et al. | |
| 8,312,922 | B2 | 11/2012 | Nelson | |
| 2011/0316236 | A1 | 12/2011 | Gette et al. | |
| 2013/0093140 | A1 | 4/2013 | Gette et al. | |
| 2014/0131054 | A1 | 5/2014 | Raynal et al. | |
| 2014/0238699 | A1 | 8/2014 | Gette et al. | |
| 2015/0114622 | A1 * | 4/2015 | Gadre | E21B 33/04 166/208 |

FOREIGN PATENT DOCUMENTS

| | | |
|---|---|---|
| EP | 0289105 A2 | 11/1988 |

OTHER PUBLICATIONS

PCT Search Report and Written Opinion issued in connection with corresponding Application No. PCT/US2015/051916 on Feb. 1, 2016.

* cited by examiner

*Primary Examiner* — Giovanna C Wright
(74) *Attorney, Agent, or Firm* — Hogan Lovells US LLP

(57) ABSTRACT

A wellbore system includes a sealing assembly for creating an annular seal between wellbore members. The sealing assembly includes a wicker profile defined a first sealing surface for engaging and embedding into a radially adjacent, second sealing surface. The wicker profile includes a first section having a first hardness and a second section adjacent to the first section and having a second hardness greater than the first hardness. Both the first and second sections of wickers are embedded into the second sealing surface, and can thus provide a high degree of both sealing and lockdown performance.

17 Claims, 4 Drawing Sheets

WELLBORE SEALING WITH HYBRID WICKER SYSTEM

BACKGROUND OF THE INVENTION

1. Field of the Invention

The present invention relates in general to methods and apparatuses for forming high pressure seals between two wellbore members, e.g., casing members operable in wells for the recovery of hydrocarbons or other minerals. More specifically, the invention relates to an annular sealing assembly that includes ridges and grooves called "wickers," which are arranged to provide both an effective sealing engagement with adjacent wellbore members and an axial restraint of the wellbore members.

2. Description of the Related Art

In an oil or gas well, a wellhead will generally be located on the ground surface or on the sea floor for a subsea well. The wellhead is generally a tubular member having an axial bore through which other wellbore members may extend. For instance, a casing hanger often extends through the wellhead to support a casing string that extends below the wellhead into the well. A casing hanger is usually supported on at least one load shoulder within the axial bore such that an annular pocket is defined between the casing hanger and the wellhead. An annular sealing assembly may be provided within the annular pocket, e.g., to contain internal well pressure.

There are many types of annular sealing assemblies. Many of these sealing assemblies include sealing bodies constructed of rubber, other elastomeric materials, or metallic components. One type of seal body for creating a metal-to-metal seal has a u-shaped cross-section defined by inner and outer legs. The inner and outer legs are radially separated from one another and coupled to one another at their lower ends. An energizing ring is pressed downwardly into an annular clearance between the inner and outer legs to force the legs apart, and thereby force the legs into sealing engagement with adjacent wellbore members. The adjacent wellbore members may include, e.g., the wellhead and casing hanger.

Often the adjacent wellbore members include sealing surfaces for engaging the inner and/or outer legs, and often these sealing surfaces include wickers. Wickers are generally defined by adjacent ridges and valleys disposed in a generally parallel configuration. Wickers are generally distinguishable from threads, in which ridges and valleys may be disposed in helical pattern. When wickers are provided on both an exterior sealing surface of the casing hanger and on an interior sealing surface of the wellhead, the inner leg of the seal body embeds into the wickers of the casing hanger and the outer leg of the seal body embeds into the wickers of the wellhead. The legs of the seal body are often constructed of a metal that is softer than the wickers such that the wickers "bite" into the legs as the legs are embedded. The embedded legs effectuate a seal, and also perform a lockdown function, e.g., axially restraining the casing hanger within the wellhead.

The sealing and lockdown capacity of a sealing assembly can be affected by various factors. For instance, the relative hardness of the wickers with respect to the hardness of the seal body affects the degree to which the walls of the seal body embed into the wickers. Also fluids such as drilling mud, water, or wellbore fluid trapped in the grooves of wickers can lead to hydraulic lock, and frustrate the embedding of the walls. It is desirable to provide a high degree of both sealing and lockdown performance even when the embedding of the walls is frustrated.

SUMMARY OF THE INVENTION

Described herein is an annular sealing assembly operable to provide a seal between wellbore members. The annular sealing assembly includes a seal body having a u-shaped cross section, with walls for embedding into a wicker profile defined on at least one of the wellbore members. The wicker profile includes a first section having a relatively low hardness for effectuating a seal with a wall of the seal body and a second section having a relatively high hardness for axially embedding into the wall of the seal body for providing axial restraint between the wellbore members. The wickers can thus provide relatively high degree of both sealing and lockdown performance.

According to one aspect of the invention, a wellbore system includes an outer wellbore member defining a longitudinal axis and including an axial bore extending therethrough. A first sealing surface is defined on the outer wellbore member within the axial bore. An inner wellbore member is disposed at least partially within the axial bore of the outer wellbore member. A second sealing surface is defined on an exterior of the inner wellbore member. A seal body is disposed within an annular pocket defined between the inner and outer wellbore members, the seal body sealingly engaged with the first and second sealing surfaces. A wicker profile is defined on at least one of the first and second sealing surfaces. The wicker profile includes a first section having a first hardness and a second section having a hardness greater than the first hardness. The first and second sections of the wicker profile are embedded into the seal body.

According to another aspect of the invention, a wellhead system includes an annular wellhead housing defining a longitudinal axis and having an axial bore, an annular casing hanger mounted in the axial bore, and a seal body disposed within an annular pocket defined between the annular wellhead housing and the annular casing hanger. A housing sealing surface is defined on the annular wellhead housing within the axial bore, and a hanger sealing surface is defined on the annular casing hanger. A wicker profile is defined on at least one of the housing sealing surface and the hanger sealing surface. The wicker profile includes a first section of circumferentially extending, parallel ridges having a first hardness and a second section of circumferentially extending, parallel ridges having a second hardness greater than the first hardness. The first and second sections are axially adjacent one another and operable to embed into the seal body.

According to another aspect of the invention, a wellbore system includes an outer wellbore member including an axial bore and defines a first sealing surface within the axial bore. An inner wellbore member is disposed at least partially within the outer wellbore member such that an annular pocket is defined between the inner and outer wellbore members. The inner wellbore member defines a second sealing surface thereon. An annular seal body is disposed within the annular pocket. The annular seal body includes an outer diameter surface defining an outer sealing surface thereon, and an inner diameter surface defining an inner sealing surface thereon. The outer sealing surface is operable to be sealingly engaged with the first sealing surface, and the inner sealing surface is operable to be sealingly engaged with the second sealing surface. A wicker profile is defined on at least one of the first and second sealing surfaces. The wicker profile includes a first section having a first hardness and a second section having a second hardness greater than the first hardness. The first and second sections of the wicker profile are operable to embed into at least one of the inner sealing surface and the outer sealing surface of the seal body.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
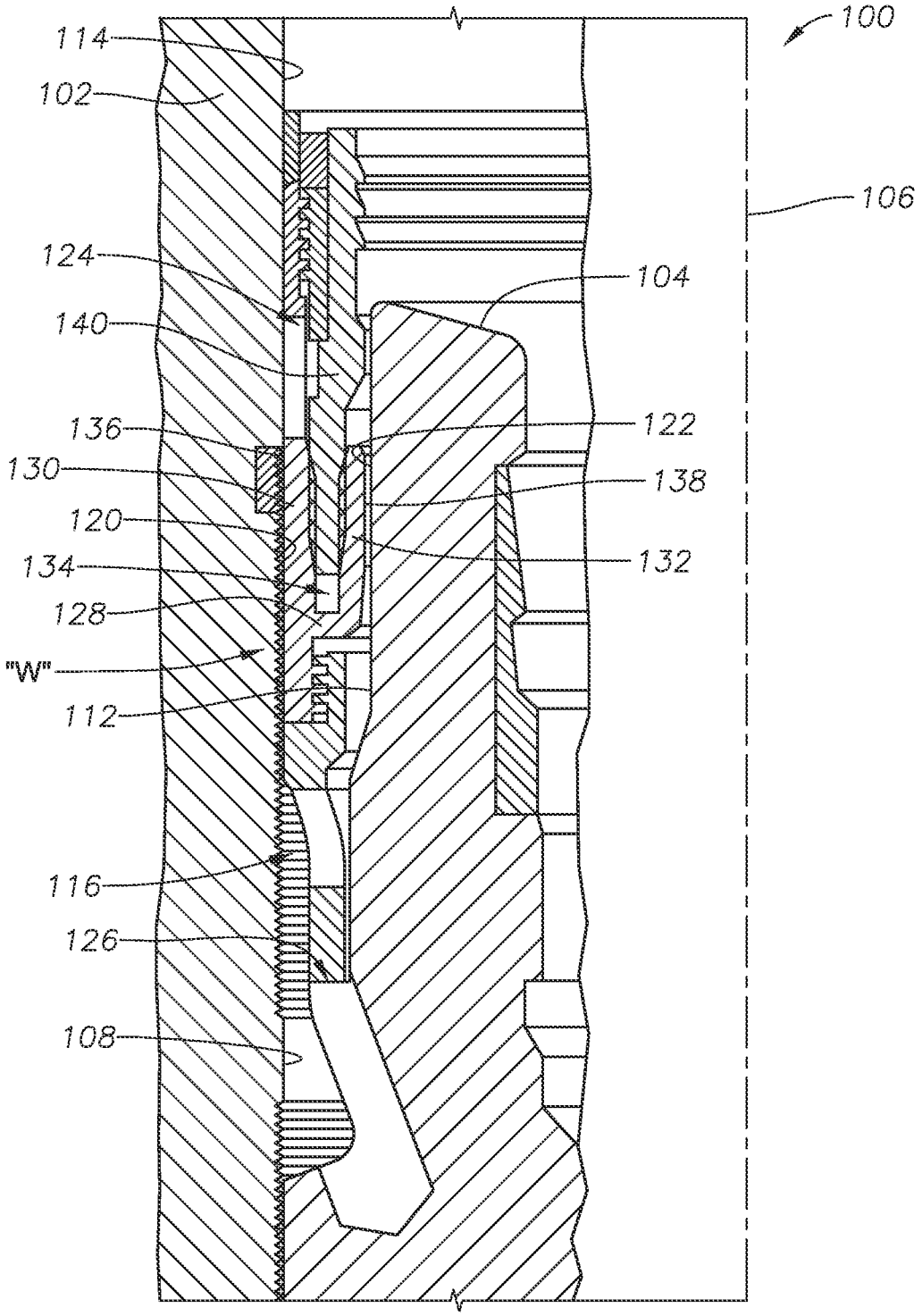
FIG. 1 is a partial, cross-sectional view of a wellbore system including an annular sealing assembly disposed between an inner tubular member and an outer tubular member in accordance with one example embodiment of the present invention.

Referring to FIG. 1, a wellbore system 100 includes an outer wellbore member such as wellhead housing 102 and an inner wellbore member such as casing hanger 104. As one of skill in the art will appreciate, other wellbore members (not shown) such as tubing hangers, fluid conduits or other generally tubular members may be provided as the outer and inner wellbore members. In the illustrated embodiment, wellhead housing 102 is a conventional high-pressure housing operable in a subsea well (not shown). Wellhead housing 102 exhibits a tubular structure circumscribing casing hanger 104, and is disposed at an upper end of the subsea well. As used herein, spatially relative terms such as "upper" and "lower" are used for ease of description to describe one element's relationship to another as illustrated in the figures, and are intended to encompass alternate orientations of the illustrated systems and devices.

Wellhead housing 102 defines a longitudinal axis 106 and includes axial bore 108 extending through wellhead housing along longitudinal axis 106. Casing hanger 104 is a tubular member disposed at least partially within axial bore 108. An upper end of a casing string (not shown) that extends into the subsea well is coupled to a lower end (not shown) of casing hanger 104. Casing hanger 104 includes an exterior wall 112, which is generally parallel and spaced radially inward from an interior wall 114 of wellhead housing 102. A clearance or annular pocket 116 is defined between exterior wall 112 of casing hanger 104 and interior wall 114 of wellhead housing 102.

A first sealing surface such as housing sealing surface 120 is located on interior wall 114 of wellhead housing 102. As used herein, numerical terms such as "first" and "second" are used for ease of description and are not necessarily intended to imply a sequence or order unless clearly indicated by the context. Thus, a "first" element discussed below could be termed a "second" element without departing from the teachings of the example embodiments described herein. A second sealing surface such as hanger sealing surface 122 is located on exterior wall 112 of casing hanger 104 radially across annular pocket 116 from housing sealing surface 120.

As described in greater detail below, housing sealing surface 120 defines a hybrid wicker profile thereon in accordance with an embodiment of the present disclosure. Hanger sealing surface 122 exhibits a generally smooth surface. As one of skill in the art will appreciate, hanger sealing surface 122 can exhibit any of a variety of surfaces textures such as wickers (see FIG. 4) or a textured surface that enhances friction while maintaining a seal.

The wickers "W" on housing sealing surface 120 are generally a series of alternating, triangularly-shaped ridges and grooves arranged in parallel relation to one another. In some embodiments, the grooves can have a depth of about 1/16 of an inch to about 1/4 of an inch. Wickers "W" can generally be constructed from a harder material than a radially adjacent seal surface such that the wickers "W" are operable to deform the radially adjacent seal surface (such as outer sealing surface 136 discussed below) to embed into the radially adjacent seal surface in response to a radially directed force approximating the wickers "W" and the radially adjacent seal surface. The wickers "W" can be used without substantial deformation or damage, and thus be subsequently re-used to form a sealing engagement with other sealing surfaces.

The housing sealing surface 120 defines a generally straight wicker profile wherein the plurality of parallel, circumferentially extending ridges of the wicker profile extend to the same radial location. In other embodiments, other profiles (not shown) are contemplated such as an angled profile wherein each circumferentially extending ridge extends to an incrementally greater extent than an adjacent ridge.

Seal assembly 124 is disposed in annular pocket 116 between exterior wall 112 and interior wall 114. Seal assembly 124 is supported on upward facing shoulder 126 of casing hanger 104. In other embodiments (not shown), the seal assembly 124 is axially supported by the wellhead housing 102. Seal assembly 124 is assembled entirely of metal components or a combination of metal and non-metal components. These components include a seal body 128, which exhibits a generally u-shaped cross section having an outer leg 130 and a parallel inner leg 132. Outer leg 130 and inner leg 132 are connected to one another near lower or connected ends thereof and separated from one another near upper or free ends thereof. Inner and outer legs 130, 132 are radially separated from one another defining an annular clearance 134 therebetween. Within the annular clearance 134, inner and outer legs 128, 130 exhibit generally smooth cylindrical surfaces, which are generally parallel with one other. An outer diameter surface of outer leg 130 includes outer sealing surface 136 for engaging housing sealing surface 120, and an inner diameter surface of inner leg 132 includes inner sealing surface 138 for engaging hanger sealing surface 122. In some embodiments, the outer leg 130 is constructed of a relatively soft material with respect to the wickers "W" on sealing housing sealing surface 120, such that the wickers "W" on housing sealing surface 120 can bite into the outer sealing surface 136. In some embodiments, the outer leg 130 is constructed of low-carbon steel.

An energizing ring 140 is disposed above seal body 128. Energizing ring 140 is axially movable with respect to seal body 128 such that energizing ring can be moved into annular clearance 134. The radial thickness of energizing ring 140 is greater than an initial radial dimension of annular clearance 134 such that movement of energizing ring into annular clearance serves to urge outer leg 130 and inner leg 132 radially apart from one another and into sealing engagement with housing sealing surface 120 and hanger sealing surface 122, respectively. The radial force applied to the legs 130, 132 by movement of the energizing ring 140 into the annular clearance 134 can vary axially along the legs. For instance, in some embodiments, the radial force applied to the upper or free ends of the legs 130, 132 can be greater than the radial force applied to lower or connected ends of the legs 130, 132. The wickers "W" defined on housing sealing surface 120 bite into outer sealing surface 136, thereby forming a seal between wellhead housing 102 and seal body 128, and also axially restraining seal body 128 with respect to wellhead housing 102.

Figure 2:
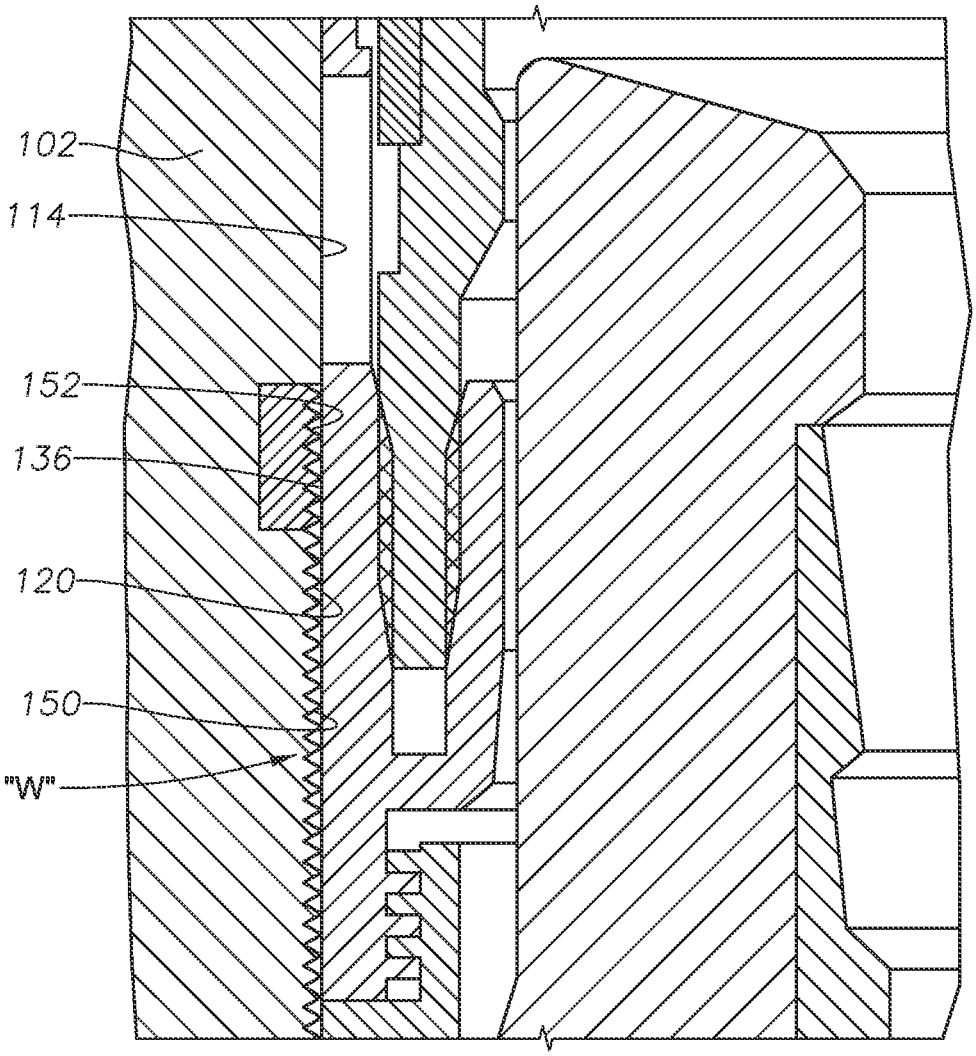
FIG. 2 is an enlarged view of the area of interest identified in FIG. 1 illustrating a wicker profile defined on the outer tubular member.

Referring now to FIG. 2, the wickers "W" defined on housing sealing surface 120 include a first section 150 having a relatively low hardness and/or yield strength, and a second section 152 having a relatively high hardness and/or yield strength. The first and second sections 150, 152 are adjacent one another such that a substantially continuous wicker profile is defined in an axial direction along the housing sealing surface 120.

In some embodiments, the first section 150 is constructed of the base material of wellhead housing 102. As used herein, the term "base material" includes a material forming a structural base for the component to which or from which other materials or components can be affixed or removed. In the embodiment illustrated in FIG. 2, the first section 150 of wickers "W" is formed by machining or removing material from the interior wall 114 of the wellhead housing 102 to form grooves and leaving ridges therebetween.

In some embodiments, wellhead housing 102 and the first section 150 of wickers "W" are constructed of a carbon steel alloy such as 8630-modified low alloy steel. The 8630-modified low alloy steel exhibits a yield-strength of approximately 80 ksi. One standard for materials used in corrosive environments such as in oil and gas production is NACE (National Association of Corrosion Engineers) standard "MR 0175", entitled: "Petroleum and Natural Gas Industries-Materials for Use in $H_2S$-containing Environments in Oil and Gas Production." For corrosion protection, NACE standard MR 0175 limits the hardness of 8630-modified low alloy steel for use in corrosive environments in oil and gas production to a hardness of 22 Rockwell C ("HRC"). Thus, in some embodiments where NACE standard MR 0175 is applicable, the first section 150 of wickers "W" exhibits a hardness of less than 22 HRC and a yield-strength of approximately 80 ksi. The wickers "W" in the first section 150 can be manufactured with relatively liberal or large manufacturing tolerances since a primary function of these wickers "W" is to provide a seal with outer sealing surface 136, rather than to provide both lockdown and sealing capacities as described in greater detail below.

In some embodiments, the second section 152 of wickers "W" is constructed of a high strength alloy, such as high-carbon steel or a nickel alloy. In some embodiments, the second section 152 is constructed from an Inconel or austenitic nickel-chromium-based alloy such as nickel alloy 725 (UNS N07725). In some embodiments, the high strength alloy of the second section 152 of wickers "W" has a yield-strength in the range of approximately 120 to approximately 130 ksi. The hardness of the wickers "W" in the second section 152 depends on the material of construction and the subsequent treatments such as heat treating. In some embodiments, the hardness of the wickers "W" in the second section 152 is in the range of approximately 20 HRC to greater approximately 37 HRC. In some embodiments, the hardness of the wickers "W" in the second section 152 is greater than approximately 22 HRC, and in some embodiments, the hardness is in the range of approximately 27 HRC to approximately 29 HRC.

Figure 3:
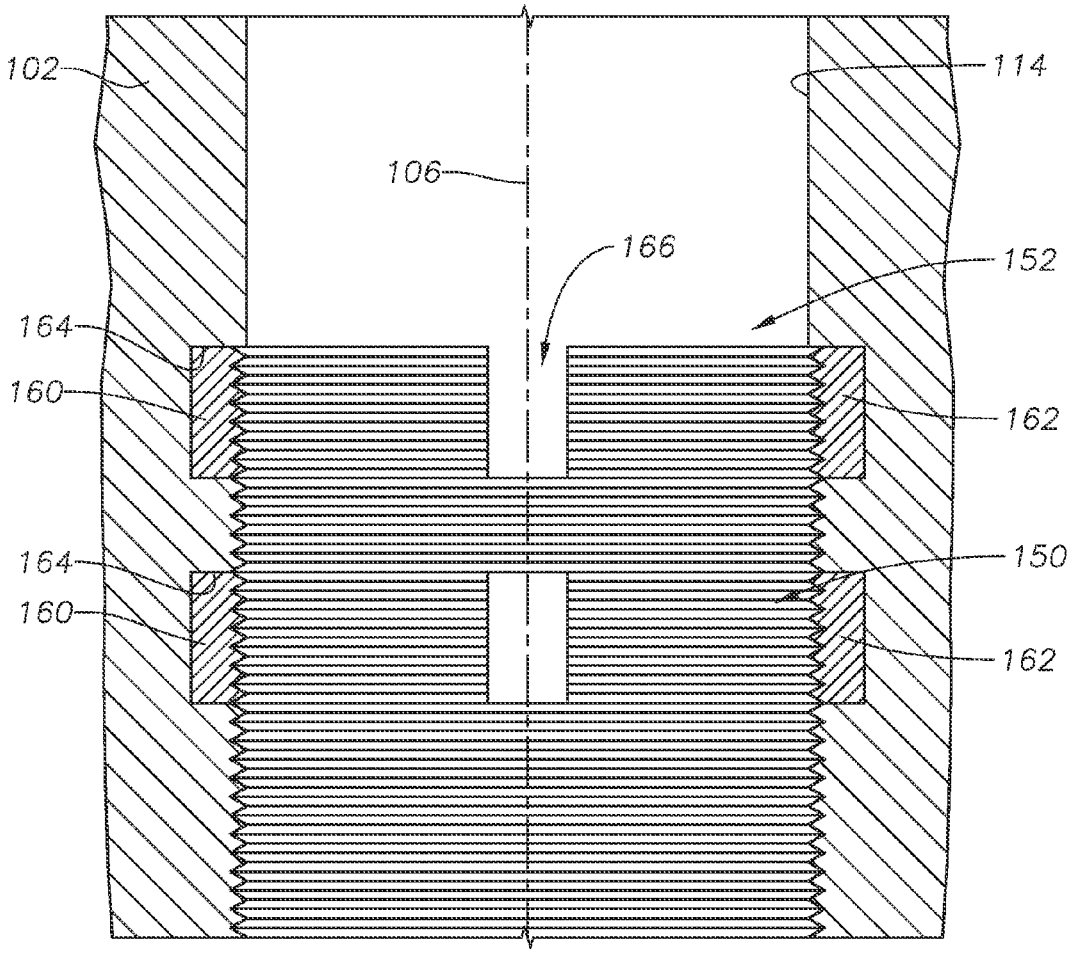
FIG. 3 is a partial, cross-sectional view of the outer tubular member of FIG. 1 illustrating a high-strength insert defining a section of the wicker profile.
Figure 4:
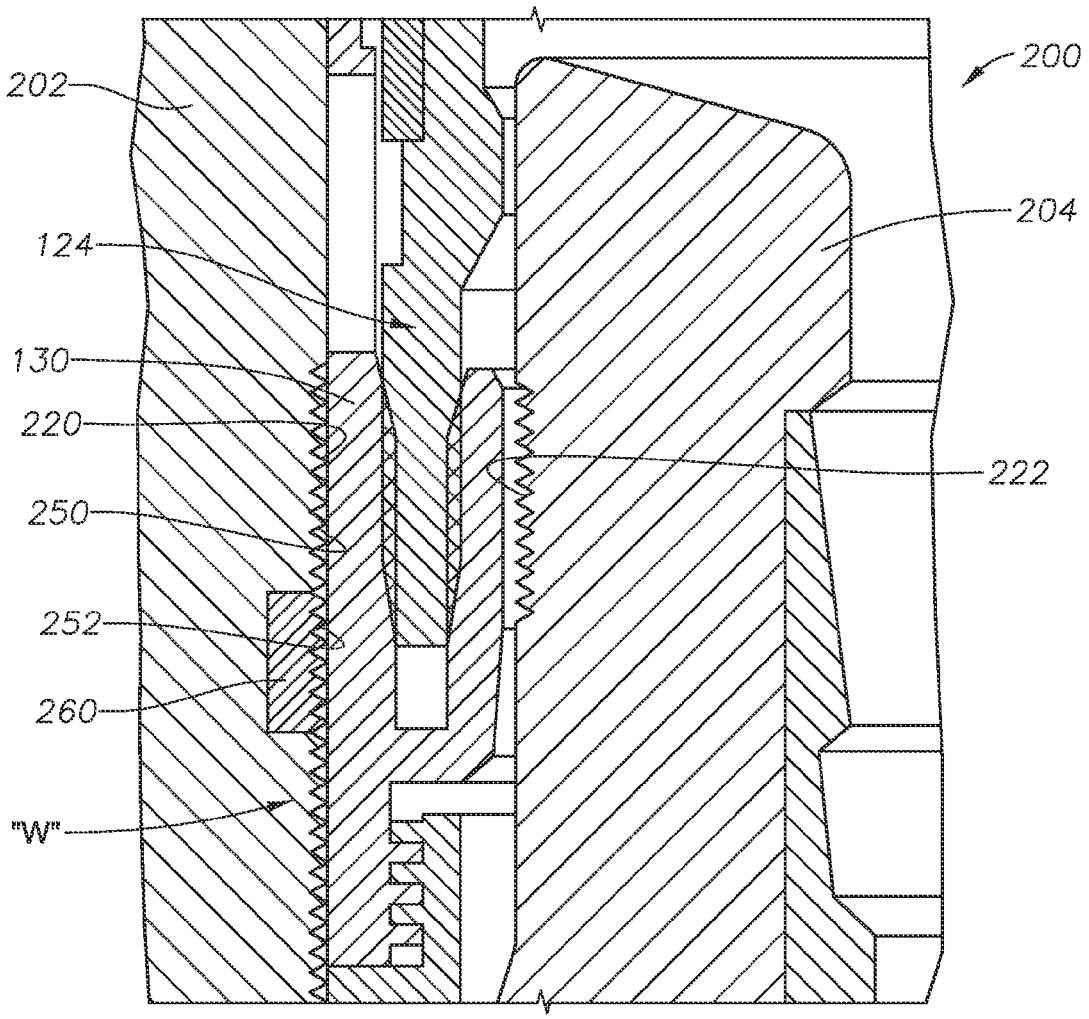
FIG. 4 is a partial, cross-sectional view of a wellbore system including an annular sealing assembly in accordance with an alternate example embodiment of the present invention.

Referring to FIG. 3, the second section 152 of wickers "W" is constructed as a plurality of inserts, e.g., a pair of circumferentially spaced inserts 160, 162, disposed within an annular groove 164 defined in wellhead housing 102. In other embodiments (not shown), three (3), four (4) or any number of inserts may be provided within annular groove 164 to substantially circumscribe the longitudinal axis 106. The annular groove 164 extends about a full circumference of interior wall 114 and circumscribes longitudinal axis 106. In the example of FIG. 3, two (2) annular grooves 164 are shown. In other embodiments, as shown in FIGS. 1, 2 and 4, wellhead housing 102 can have one (1) annular groove 164. In yet other embodiments (not shown), wellhead housing 102 can have more than two (2) annular grooves 164. In embodiments having more than one annular groove 164, the axial height of each annular groove 164 can differ between annular grooves 164. The axial height of each annular groove 164 can be reduced in embodiments with more than one annular groove 164 in order to accommodate the additional annular grooves 164 on housing sealing surface 120.

Inserts 160, 162 can be individually machined and heat treated, and subsequently welded into groove 164. Alternatively, inserts 160, 162 can be installed in wellhead housing 102 by fasteners (not shown), deposited therein by laser metal deposition techniques, or by other manufacturing methods as understood by those skilled in the art. The wickers "W" on inserts 160, 162 can be manufactured with relatively large manufacturing tolerances since a primary function of the wickers "W" in the second section 152 is to bite into outer sealing surfaces 136 (FIG. 2) to provide a lockdown capacity, rather than to provide both lockdown and sealing capacities as described in greater detail below. Inserts 160, 162 are circumferentially spaced such that a longitudinal channel 166 or channels are defined within the annular groove 164 between each adjacent insert 160, 162 within the annular groove 164.

Referring to FIGS. 1 through 3, in operation, energizing ring 140 is moved into annular clearance 134 to push outer leg 130 radially outward such that outer sealing surface 136 engages housing sealing surface 120. Outer leg 130 imbeds into first and second sections 150, 152 of wickers "W" to differing degrees. Since the wickers "W" in the second section 152 are stronger and harder than the wickers "W" in the first section 150, the second section 152 of wickers "W" bites or penetrates into outer sealing surface 136 to a greater degree than the first section 150 of wickers "W." The deeper penetration and lower tendency of the second section 152 to yield serve to provide a relatively large lockdown capacity, e.g., the tendency for casing hanger 104 to resist axial movement with respect to wellhead housing 102. The channel or channels 166 provide a pathway for incompressible fluids such as drilling mud, water, or wellbore fluid disposed within in the grooves of wickers "W" to escape as outer sealing surface 136 embeds into the wickers "W." Thus, longitudinal channel 166 serves to discourage hydraulic lock. Discouraging hydraulic lock allows for deeper penetration of the second section 152 of wickers "W" into the outer sealing surface 136 for a given force applied by energizing ring 140.

The relatively soft wickers "W" in the first section 150 serve to provide a relatively high sealing capacity, due at least in part a tendency of the relatively soft wickers "W" to deform against outer sealing surface 136. Thus, together the first and second sections 150, 152 of the wickers "W" can thus provide both a relatively high sealing capacity and lockdown capacity.

The inner leg 132 is urged radially inward such that inner sealing surface 138 engages hanger sealing surface 122. As illustrated, inner sealing surfaces 138 and hanger sealing surface 122 are both generally flat surfaces constructed of the base material of the respective components, i.e., inner leg 132 of seal body 128 and casing hanger 104. Other arrangements are contemplated as described with reference to FIG. 4 below.

Referring to FIG. 4, an alternate embodiment of a wellbore system 200 includes an outer wellbore member 202 and an inner wellbore member 204. Seal assembly 124 is provided for creating a seal with outer member sealing surface 220 defined on outer wellbore member 202 and inner member sealing surface 222 defined on inner wellbore member 204. Outer member sealing surface 220 includes a first section 250 disposed generally above a second section 252. The first section 250 is disposed adjacent the upper or free end of outer leg 130 and second section 252 is disposed adjacent the lower or connected end of outer leg 130.

Wickers "W" in the first section 250 are constructed of the base material of outer wellbore member 202 and second section 252 is constructed of a plurality of inserts 260 with wickers "W" constructed thereon. In some embodiments, the wickers "W" on inserts 260 are constructed of Inconel or another material that is harder and/or stronger than the base material of outer wellbore member 202. The wickers "W" on inserts 260 can be constructed of any of the materials described above for the construction of inserts 160, 162 (FIG. 3) of the materials for the construction of the "high strength wickers" in described in commonly owned, U.S. Pat. No. 8,245,776, which is hereby incorporated by reference herein in its entirety.

In other embodiments, the wickers "W" on the inserts 260 are constructed to be softer and more malleable than the base material of outer wellbore member 202. For example, the wickers "W" on the inserts can be constructed of any of the soft inlay materials described in commonly owned, U.S. Patent Application Publication Nos. 2011/0316236 and 2014/0131054, both of which are hereby incorporated by reference herein in their entirety. Whether the wickers "W" on the inserts 260 are harder or softer than the base material, the wicker profile having a variable or hybrid hardness along a length thereof can provide enhanced sealing and lockdown capabilities.

Inner member sealing surface 222 on the inner wellbore member 204 defines a second wicker profile thereon. As illustrated, the inner member sealing surface 222 includes wickers constructed of a base material of the inner wellbore member 204, which in some embodiments is a carbon steel alloy. In other embodiments, the inner member sealing surface 222 can include a generally smooth or flat surface of the base material, or a metal inlay constructed of a softer material than the a base material of the second wellbore member.

In the embodiments described above, wickers "W" are described as being formed on outer wellbore members 102, 202 and outer wellbore members 104, 204, which are embedded into sealing surfaces 136, 138 on seal body 128. In other embodiments (not shown), wickers "W" are defined on a seal body which are embedded into sealing surfaces of the inner and outer wellbore members.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wellbore system comprising:

an outer wellbore member defining a longitudinal axis and including an axial bore extending therethrough, and wherein a first sealing surface is defined on the outer wellbore member within the axial bore;

an inner wellbore member disposed at least partially within the axial bore of the outer wellbore member, and wherein a second sealing surface is defined on an exterior of the inner wellbore member;

a seal body disposed within an annular pocket defined between the inner and outer wellbore members, the seal body sealingly engaged with the first and second sealing surfaces; and a wicker profile defined on at least one of the first and second sealing surfaces, the wicker profile including a first section having a first hardness and a second section having a hardness greater than the first hardness, wherein the first section of the wicker profile is constructed of a base material of at least one of the outer wellbore member and the inner wellbore member, wherein the second section of the wicker profile is constructed of at least one insert disposed within an annular groove defined within the base material of the at least one of the outer wellbore member and inner wellbore member, and wherein the first and second sections of the wicker profile are embedded into the seal body.

2. The wellbore system of claim 1, wherein the at least one insert is constructed of a nickel alloy with a hardness of at least 22 HRC.

3. The wellbore system of claim 1, wherein the at least one insert comprises a plurality of inserts, and wherein each insert of the plurality of inserts is circumferentially spaced from adjacent inserts such that a channel is defined between the adjacent inserts.

4. The wellbore system of claim 1, wherein the first and second sections of the wicker profile are disposed axially adjacent one another such the wicker profile is substantially continuous in an axial direction along the at least one of the first and second sealing surfaces.

5. The wellbore system of claim 4, wherein the wicker profile is generally straight in an axial direction such that each of a plurality of circumferentially extending, parallel ridges defining the wicker profile extends to the same radial location.

6. The wellbore system of claim 5, wherein the seal body exhibits a generally u-shaped cross section including outer leg and a parallel inner leg, and wherein the outer leg and inner leg are operable to be urged in a radial direction by movement of an energizing ring into an annular clearance between the outer leg and inner leg to thereby imbed the first and second sections of the wicker profile into at least one of the outer leg and the inner leg.

7. The wellbore system of claim 6, wherein the second section of the wicker profile is disposed adjacent a free end of the at least one of the outer leg and the inner leg and wherein the first section of the wicker profile is disposed adjacent a connected end of the outer leg and the inner leg.

8. The wellbore system of claim 6, wherein the first section of the wicker profile is disposed adjacent a free end of the at least one of the outer leg and the inner leg and wherein the second section of the wicker profile is disposed adjacent a connected end of the outer leg and the inner leg.

9. The wellbore system of claim 1, wherein the wicker profile is defined on the first sealing surface within the axial bore of the outer wellbore member.

10. A wellhead system comprising:

an annular wellhead housing defining a longitudinal axis and including an axial bore;

an annular casing hanger mounted in the axial bore;

a seal body disposed within an annular pocket defined between the annular wellhead housing and the annular casing hanger;

a housing sealing surface defined on the annular wellhead housing within the axial bore;

a hanger sealing surface defined on the annular casing hanger; and a wicker profile defined on at least one of the housing sealing surface and the hanger sealing surface, the wicker profile including a first section of circumferentially extending, parallel ridges having a first hardness and a second section of circumferentially extending, parallel ridges having a second hardness greater than the first hardness, wherein the second section of circumferentially extending, parallel ridges is constructed on at least one insert disposed within an annular groove defined within the base material of the wellhead housing, and wherein the first and second sections are axially adjacent one another and operable to embed into the seal body.

11. The wellhead system of claim 10, wherein the wicker profile is defined on the housing sealing surface within the axial bore of the annular wellhead housing.

12. The wellhead system of claim 11, wherein the wellhead housing is constructed of a carbon steel alloy base material, and wherein the first section of circumferentially extending, parallel ridges is constructed of the base material having a hardness of less than 22 HRC.

13. The wellhead system of claim 10, wherein the at least one insert is constructed of a material having a hardness of at least 22 HRC.

14. The wellhead system of claim 10, wherein the annular groove substantially circumscribes the longitudinal axis, and wherein the at least one insert includes a plurality of circumferentially spaced inserts such that a longitudinal channel is defined within the annular groove between adjacent inserts.

15. The wellhead system of claim 11, wherein the hanger sealing surface defines at least one of the following: a generally smooth surface; a second wicker profile and a metal inlay constructed of a softer material than a base material of the annular casing hanger.

16. A wellbore system, comprising:

an outer wellbore member including an axial bore and defining a first sealing surface within the axial bore;

an inner wellbore member disposed at least partially within the outer wellbore member such that an annular pocket is defined between the inner and outer wellbore members, the inner wellbore member defining a second sealing surface thereon;

an annular seal body disposed within the annular pocket, the annular seal body including an outer diameter surface defining an outer sealing surface thereon and an inner diameter surface defining an inner sealing surface thereon, the outer sealing surface operable to be sealingly engaged with the first sealing surface, and the inner sealing surface operable to be sealingly engaged with the second sealing surface; and a wicker profile defined on at least one of the first and second sealing surfaces, the wicker profile including a first section having a first hardness and a second section having a second hardness greater than the first hardness, wherein the second section of the wicker profile is constructed of at least one insert disposed within an annular groove defined within the base material of the at least one of the outer wellbore member and inner wellbore member, and wherein the first and second sections of the wicker profile are operable to embed into at least one of the inner sealing surface and the outer sealing surface of the seal body.

17. The wellbore system of claim 16, wherein the second section of the wicker profile is operable to embed into the at least one of the inner sealing surface and the outer sealing surface to a greater degree than the first section of the wicker profile.

* * * * *